US007244006B2

(12) United States Patent
Schwaerzler et al.

(10) Patent No.: US 7,244,006 B2
(45) Date of Patent: Jul. 17, 2007

(54) PANEL ADJUSTMENT DEVICE

(75) Inventors: Erich Schwaerzler, Langenegg (AT); Markus Albrecht, Lustenau (AT); Wolfgang Mueller, Lustenau (AT)

(73) Assignee: Grass GmbH, Hochst/Voralberg (AT)

( * ) Notice: Subject to any disclaimer, the term of this patent is extended or adjusted under 35 U.S.C. 154(b) by 292 days.

(21) Appl. No.: 10/717,256

(22) Filed: Nov. 19, 2003

(65) Prior Publication Data

US 2004/0119387 A1 Jun. 24, 2004

(30) Foreign Application Priority Data

Nov. 22, 2002 (DE) ..... 102 54 772

(51) Int. Cl.
*A47B 88/18* (2006.01)

(52) U.S. Cl. ..... 312/334.4

(58) Field of Classification Search ..... 312/334.4, 312/334.5, 334.7, 334.8, 330.1, 348.1, 348.2, 312/348.4

See application file for complete search history.

(56) References Cited

U.S. PATENT DOCUMENTS 2,928,696 A * 3/1960 Hiers ..... 384/19
3,768,883 A * 10/1973 Kauffman ..... 312/351
4,291,929 A 9/1981 Faust
4,679,950 A * 7/1987 Delmege et al. ..... 384/18

(Continued)

FOREIGN PATENT DOCUMENTS

AT 399086 5/1989
DE 2422408 * 10/1975
JP 2001258666 9/2001

*Primary Examiner*—David Dunn
*Assistant Examiner*—Noah Chandler Hawk
(74) *Attorney, Agent, or Firm*—John M. Harrington; Kilpatrick Stockton LLP

(57) ABSTRACT

The invention concerns a panel adjustment device for a drawer (2) that is equipped with a front panel (3), which is located in a cabinet (1) by means of a rail system (4) with at least one each of a drawer rail (10), a cabinet rail (18) and, optionally a drawer-décor profile (6) that is guided on both sides lengthwise; whereby, the panel adjustment device is suitable for changing the enclosed inclination angle (9) between the vertical level of the front fore side (1*a*) of the cabinet (1) and the vertical level of the front panel (3) of the drawer (2), and the panel adjustment device works directly or indirectly between the drawer (2) and the drawer rail (10) by a lifting and lowering device (15, 12; 23) that has a lifting and lowering element (11) so that a swiveling of the drawer (2) (and with it, the panel [3]) is possible around a swiveling axis (24); whereby, the swiveling axis (24) runs between the front panel (3) and the lifting and lower element (11), and the distance between the swiveling axis (24) and the front panel (3) is somewhat larger or smaller than the distance between the swiveling axis (24) and the lifting and lower element (11). The advantage is an economical panel adjustment device, which makes a simple, easy and quick adjustment of the inclination angle (9) between the vertical level of the front panel (3) of the drawer (2) and the vertical level of the front fore side (1*a*) of the cabinet (1), without a panel correction in the inclination (9) of the height (27) being necessary. Likewise, the simple operation of the panel adjustment device at the front of the drawer component, makes it possible to make adjustments without the necessity of removing the drawer (2).

12 Claims, 5 Drawing Sheets

U.S. PATENT DOCUMENTS

| | | | | |
|---|---|---|---|---|
| 4,842,422 | A * | 6/1989 | Nelson | 384/19 |
| 5,002,346 | A | 3/1991 | Gasser | |
| 5,147,124 | A | 9/1992 | Grass et al. | |
| 5,211,461 | A * | 5/1993 | Teufel et al. | 312/334.4 |
| 5,375,922 | A * | 12/1994 | Brustle et al. | 312/334.4 |
| 5,492,400 | A * | 2/1996 | Rock | 312/331 |
| 5,664,855 | A * | 9/1997 | Lautenschlager et al. | 312/334.4 |
| 6,585,336 | B2 * | 7/2003 | Munday et al. | 312/334.4 |
| 2001/0019235 | A1 * | 9/2001 | Hammerle | 312/334.4 |
| 2003/0234603 | A1 * | 12/2003 | Salice | 312/334.5 |

* cited by examiner

PRIOR ART

PANEL ADJUSTMENT DEVICE

FIELD OF THE INVENTION

The invention concerns a panel adjustment device according to the characterizing introductory clause of the independent claims.

BACKGROUND OF THE INVENTION

AT 399 086 B shows an adjustment device for an adjustable drawer panel that operates when the panel is slanted around an amount diverging from the perpendicular by a lengthwise-adjustable railing. This type of angle adjustment is possible only if the drawer has railings.

The disadvantage of this design is the requirements of the railings as mentioned and that either a conical gap develops between the Zargen-slide and the panel or the screw-on angle is forced to bend.

Document DE 38 43 658 A1 shows a panel attachment, which the inclination of the panel is likewise adjusted, but, however, with a movable wedge. The conical gap formed there must be protected with a special cover to make it invisible and to protect it from dirt or other contamination. The bending of the screw-on angle can be intentional or can be generally prevented by loosening the fastening screws extensively.

Document AT 409 067 B shows a device, already closer to the invention, for the height and angle adjustment of the entire drawer with a front panel. The device is located between the drawer and drawer rail. Here, movable wedges are located in the front area of the drawer. They result in a height reconciliation, as well as an angle adjustment of the drawer's front panel. The means to provide the vertical adjustment to lift the drawer is provided in the rear area of the drawer, which likewise, also causes an angle adjustment of the drawer's front panel. How the wedges are moved on both sides is not shown here.

In order to correct the height of the drawer after the drawer's angle adjustment, complex shifting devices of the wedges must also be present. These complex shifting devices of the wedges must also be present if the panel's height, position is first set or adjusted, and afterwards, the reveal diagram is corrected by a drawer-panel-angle. A serious disadvantage is that the angle adjustment is located behind the drawer. To operate it, the drawer must be pulled out of the drawer. Until the panel is adjusted, it may be necessary for the user to push and pull the drawer in and out multiple times. So, the adjustment device is complicated and time-consuming to operate. Additionally, it is also relatively expensive to produce.

Document DE 44014 462 A1 shows the height adjustment of the drawer with the front panel, which device is located between the drawer and drawer rail. In the front drawer area the drawer with the panel can be raised or also (from the center position) lowered with a movable slide that is in the angled running slide slots. The disadvantage with this system is that a gap change (depth and angle) is caused by the vertical adjustment and this gap change cannot be balanced or adjusted anymore, which leads to the need for an additional adjustment device.

Besides, both devices named, have the disadvantage that a speed increase ratio of approximately 1.25 to 1.5 is present, so that a 1 mm height adjustment of the height adjustment device results in approximately 1.25 to 1.5 mm height adjustment of the drawer's front panel. The lever ratios shown here cause the following: for every degree of the drawer's angle change, the front panel changes approximately 0.25 mm, which is nevertheless substantial, with adjustable angles of +/−10 degrees of angle, which leads to a maximum deviation of 2.5 mm, which is in each case too much without some sort of compensation, in order not to become visibly apparent.

The task is, stemming from the above mentioned state of technology, is to develop an economical panel adjustment device, which makes a simple and quick adjustment of the angle inclination between the vertical level of the drawer's front panel and the vertical level of the cabinet's front side possible.

SUMMARY OF THE INVENTION

It is fundamental that the panel adjustment device works in such a manner directly or indirectly between the drawer and the drawer rail by means of a lifting and lowering element, so that a swiveling of the drawer (and with it, the panel) is made possible around a swiveling axis. So, the swiveling axis runs between the front panel and the lifting and lowering element, and the distance between the swiveling axis and the front panel is about a large or small as the distance between the swiveling axis and the lifting and lowering element.

It is preferred that the swiveling axis is as close to the front panel as possible and/or the lifting and lower element is as far away from the swiveling axis as possible.

The fundamental advantage here is that after the panel angle has been corrected, no reconciliation is necessary for the height. A further advantage is that an adjustment of the angle inclination is possible without a conical gap resulting between the décor side-wall fore-side and the panel and without a buckling and/or bending occurring at the side-wall fore-side, as happens partially with the current state of technology. Likewise, the simplest operation of the panel adjustment device is possible on the front drawer part without removing the drawer.

Therefore, a reconciliation or equalization of the panel's height, after the inclination angle has been adjusted, is no longer necessary since there is no increased speed ratio of the lifting and lowering element's height deflection of the front panel, as is the case with the current state of technology. Instead, a reduced speed ratio exists with the same deflection angle of the drawer and/or front panel's inclination angle. With the initial cited current state of technology, according to the figures, the increased speed ratio has a minimum 1.25; however, can naturally never be less than 1. The reduced speed ratio of the invention, due to the special arrangement among the fulcrum, the lifting and lowering element, and the panel is below 1 (for example, about 0.3). As a result the front panel changes about 0.05 mm per degree that the drawer angle changes (thus, only 20% of the value of the state of technology). By certain changes of the distance among the fulcrum, lifting and lowering element, and panel, this value can be guided even further to the direction zero. However, it is essential for the invention that a reduced speed ratio is less than (or the same as) 1, which is, preferably, kept as small as possible, but typically, lies below approximately 0.25. The reduced speed ratio of 0.25 means that for 1 degree of the drawer's angle change and the panel that is attached to it, a height adjustment of the lifting and lowering element is necessary (for example, 2 mm); and then the connected and unwanted height of the panel changes around 0.5 mm. If the increased speed ratio with the state of technology is greater than 1, a panel's height is noted as 2.5 mm, which must, in each case, be equalized or reciprocated by additional devices.

So, for a reduced speed ratio, according to the presented invention, it is necessary that the distance of the panel to the swiveling axis of the drawer and/or décor on the drawer rail is smaller and, at the very most, equal in size, which is possible only if the swiveling axis is located between the panel and the lifting and lowering element.

It is preferred that the swiveling axis lies on the drawer rail and that the lifting and lowering element, in particular, is located in the rear area of the drawer décor, especially on its lower part.

Here, it is preferred that the lifting and lowering device has a slider, which contains the lifting and lowering element, a connection element and an operating element for the lifting and lowering element. The lifting and lowering element is located in the rear area of the drawer, which is connected with an operating element (located in the front area of the drawer) for the lifting and lowering element by a connection element.

The advantage here is that by having the operating elements for the lifting and lowering element in the front area of the drawer, a simple and easily accessible operation of the lifting and lowering element in the rear area of the drawer becomes possible and, with it, the adjustment of the inclination angle of the drawer's front panel. The invention, thus, separates spatially the functions of the lifting and lowering element and so, the lifting and lowering of the drawer (i.e., the adjustment of the drawer's inclination) and with it, the connected panel.

In particular the operating element for the lifting and lowering element is located in the front area of the drawer itself or its décor component, and the lifting and lowering element is in the rear area on the drawer rail. The slider penetrates the drawer itself or its décor component on its way into the rear area of the drawer.

For this, it is preferred that the bearing surface of the drawer itself or its décor component and the drawer rail lies somewhat horizontal for the lifting and lowering element and its operating element and points upward, what is, however, not absolutely necessary since the vertical surfaces and the downward pointing horizontal surfaces can form, for this, a bearing, so that, however, in each case then additional holding or guiding devices are necessary.

In particular, the lifting and lowering element and its operating element are formed as a slider made of a flat material, which extends from the front into the rear slide rail area and from the front up over the center area on the one, especially the horizontal shank of the side-wall lower-part, is held movable, and in the rear area of the drawer rail, pushes away so that the end of the slider is formed as a wedge-shaped slider piece.

Preferably, the slider is bent at a right angle in its longitudinal extension a section before the lifting and lowering element and projects through a recess in the horizontal shank of the drawer's lower part to the support on the drawer rail.

The invention-related slider with the rear lifting and lowering element and front operating element for the lifting and lowering element can here have various forms. However, the lifting and lowering element is connected in one piece with the operating element and is made in one piece with the same material (for example, flat steel or wire or strip-formed plastic material).

The operating element and the lifting and lowering element of the panel adjustment device can, however, be designed/produced in another embodiment of the invention in two or more parts and are interconnected.

The operating element of the panel adjustment device has, in particular, teeth that engage by a tool (for example, a screwdriver) during the adjustment by an installer. The lengthwise shifting of the operating element along the rails causes a lifting or lowering of the lifting and lowering element. So the distance between the drawer/décor and the drawer rail changes and this modifies the inclination angle that securely connects the drawer's front panel in relation to the vertical front side of the cabinet. Inevitably, thereby, in small measure, the front panel's height changes in relation to the cabinet, which happens, however, only to an imperceptible extent.

The teeth are located favorably in the side wall of the operating element; whereby, naturally, an interlocked oblong recess (slotted hole) can be present in the operating element, into which the tool then engages. Any other equivalent mechanism should be protected by the invention. Naturally, the tool itself can be at least partially a part of the operating element and remains on the panel adjustment device, even if the adjustment procedure is terminated. So, for example, an extension of the external tool can be possible.

The entire slider or only parts of it can be guided in the slide tabs on the drawer rail and/or the drawer and/or its décor profile; the guide tabs form a horizontal and, if necessary, also a vertical slide, which still also makes a movement possible in the longitudinal axis of the rails possible, but however, not crosswise to it.

To retain the once adjusted relative position between the drawer/décor and the drawer rail, the panel adjustment device is equipped with a catch device, especially in the form of a self-restraining corrugation, which prevents an unintentional shifting of the panel adjustment device. For this corrugation, especially between the slider and the drawer and/or its décor, is provided and is located, in particular, on the drawer and/or its décor, especially in the area of the lifting and lowering element's operating element. Additionally, homogeneous corrugation can also be present as counter-teeth on the slider. The corrugation is thereby crosswise and/or slanted to the shifting direction of the slider. Corresponding stop restrictions are placed on the drawer/décor and/or on the drawer rail so that the slider of the panel adjustment device cannot be pulled out of its function position when it is moved in the longitudinal direction of the rails.

The invention at hand is more closely described in the following exemplary designs, from which further characteristics, features, advantages and applications are made known.

BRIEF DESCRIPTION OF THE DRAWINGS

FIG. 3: the correct adjusted gap between the panel and the cabinet;

FIG. 4: a first conical gap version with positive angle of inclination between the panel and the cabinet;

FIG. 5: a second conical gap version with negative angle of inclination between the panel and the cabinet;

DETAILED DESCRIPTION

Figure 2:
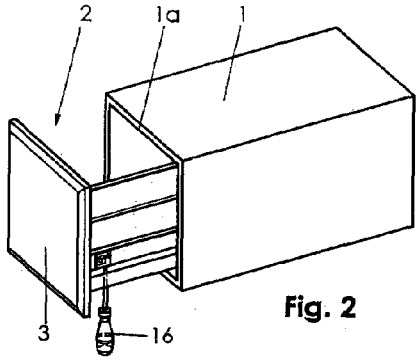
FIG. 2: a perspective representation of the drawer with an adjustment tool at the place of the adjustment in the front section of the drawer.

FIG. 2 shows a perspective of a drawer system, which has a cabinet (1) that has a drawer (2) pulled out its interior (1*b*). The front panel (3) on the outer end of the drawer (2) is almost flush to the front side (1*a*) of the cabinet (1) when the drawer (2) is closed and is separated from it by only the gap (8) (see FIGS. 3-5). The tool (16) for adjusting the front panel (3) is designed in the front area of the drawer (2), where the operating element (14) (see FIGS. 9-14) is also located. By operating (here: turning) the tool (16) the inclination of the front panel's (3) level is suitably changed in relation to the level of the cabinet's (1) front side (1*a*). A height adjustment of the panel should, if possible, not take place at all or at least only imperceptibly.

Figure 1:
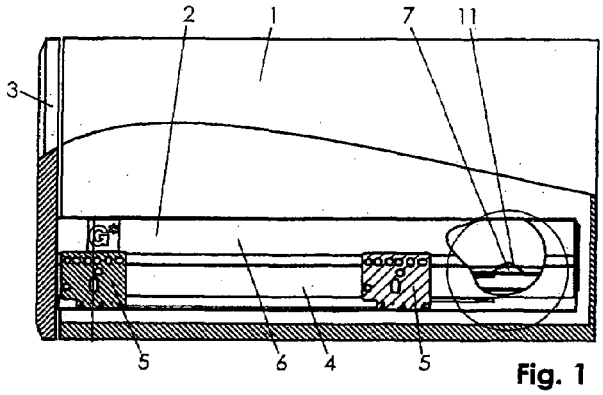
FIG. 1: a drawer with a particularly high panel in the cabinet. In the rear section of the drawer, a wedge-shaped sliding piece can be seen.

FIG. 1 shows the side shows the side view, according to FIG. 2, of the drawer system, partially in the section in the lower area. Here the front panel (3) can be seen that is fastened to a rail system (4), which forms the connection to the cabinet (1) by means of the drawer-décor (6) and the cabinet angle (5). In the rear area of the drawer system (in FIG. 1) on the other side of the front panel (3) in the rail system (4), the lifting and lowering element (11) of the panel adjustment device (7) can be seen.

Figure 3:
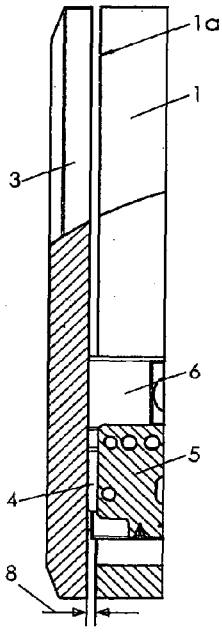
FIGS. 3, 4 & 5: an enlargement of the left front section, according to FIG. 1.
Figure 4:
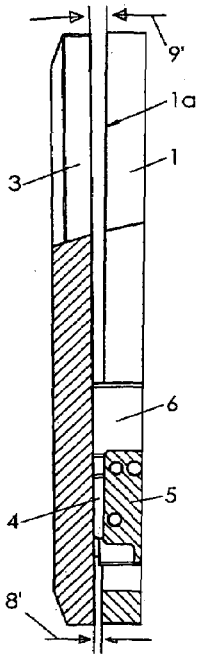
Figure 5:
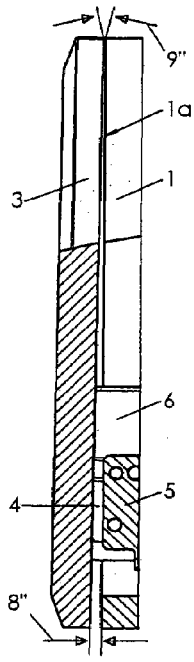

FIGS. 3-5 are enlarged to show various relative positions of the front panel (3) to the cabinet's (1) front side (1*a*), in between which there is a gap (8). Both parts (1*a* and 3) have in suitably adjusted cases, a distance between them, which typically lies between 1 and 5 mm.

FIG. 3 shows the idea case (neutral position) of a perfectly adjusted gap (8) so that the front panel's (3) level and the front side's (1*a*) level are parallel to each other and, therefore, form no angle of intersection (9) between them.

FIG. 4 shows a case in which the panel (3) is slanted/bent upward towards the front so that the gap (8') is no longer parallel, but is v-shaped, and the levels of the front panel (3) and the front side (1*a*), therefore, do not form positive intersection angles (9') (corresponding inclination angle) among themselves (for example, 2 degrees). It is simply suggested that in this case the front panel (3), in comparison to FIG. 3, is shifted easily downward. The gap (8') is smaller in the lower area and is larger in the upper area, compared to the gap (8) of FIG. 3.

FIG. 5 shows the similar opposite case of FIG. 4, which has a negative intersection angle (9") of, for example, 3 degrees. In this case, the front panel (3) compared to FIG. 3 and also to FIG. 4, is easily shifted upward. The gap (8") is larger in the lower area and smaller in the upper level, compared to the gap (8) of FIG. 3 and also to the gap (8') of FIG. 4. The panel (3) contacts the cabinet (1) above so that is represents the maximum adjustment in the direction of the negative intersection angle (9").

Figure 6:
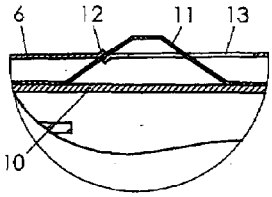
FIG. 6: the position of the wedge-shape sliding piece adapted to FIG. 3.
Figure 7:
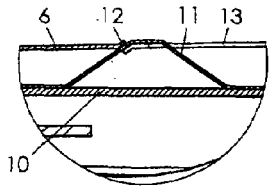
FIG. 7: the position of the wedge-shape sliding piece adapted to FIG. 4.
Figure 8:
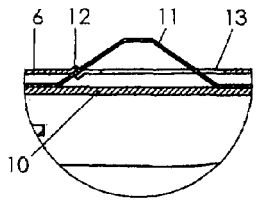
FIG. 8: the position of the wedge-shape sliding piece adapted to FIG. 5.

FIGS. 6-8 show the function of the lifting and lowering of the lifting and lowering element (11) for the cases in FIGS. 3-5, so that FIG. 6 corresponds to the situation shown in FIG. 3, FIG. 7 corresponds to the situation shown in FIG. 4 and FIG. 8 corresponds to the situation in FIG. 5.

FIGS. 6-8 show the lifting and lowering element (11) between the drawer rail (10) of the rail system (4) and the décor profile (6)—especially its side-wall-lower-component (6*c*). The lifting and lowering element (11) lies, thereby, on at least two places on the drawer rail (10) and is lifted upward roof-like in at least one area, passes upward through a narrow slide opening (12) in décor (6) and/or its side/wall-lower-component (6*c*), passes again downward distanced from there through another broader opening in décor (6) and/or its side-wall-lower-component (6*c*) and lies again on the drawer rail (10).

FIG. 6 shows the distance between the drawer rail (10) and the décor (6) and/or its side-wall-lower-component (6*c*) in the center area. In FIG. 7 this distance is large and in FIG. 8 the distance is small. This distance is managed by shifting the lifting and lowering element (11) in the direction of the drawer rail's (10) longitudinal axis and/or the décor and/or its side-wall-lower-component (6*c*). It results automatically in a rising of the décor (6) and/or its side-wall-lower-component (6*c*), if the lifting and lowering element (11) is shifted in direction panel (3). With it, the panel (3), as shown in FIG. 4, is pulled in the lower area to the front side (1*a*) of the cabinet (1). Similarly, the reverse results automatically in the sinking of the décor (6) and/or its side-wall-lower-component (6*c*), if the lifting and lowering element (11) are shifted away from the panel (3), and, thus, the panel (3) as shown in FIG. 5 is pressed away in the lower area from the front face (1*a*) of the cabinet (1).

Figure 9:
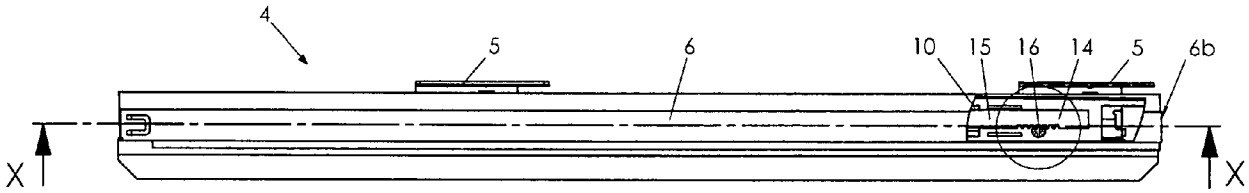
FIG. 9: an overview of the décor-side-wall with adjustment device in the front area of the side wall.

FIG. 9 represents the overview of the rail system (4) with the décor component (6), so that the décor's (6) front area is shown as cut open and results in a view of the operating element (14).

Figure 10:
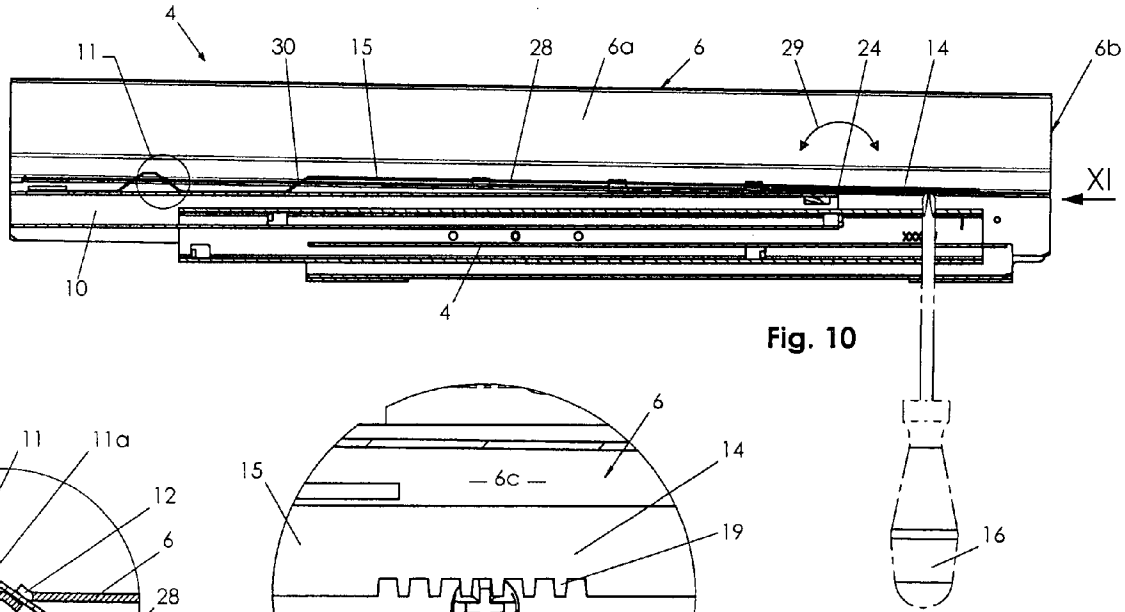
FIG. 10: a side view of the section along the line X-X of FIG. 9 with décor, rail system and adjustment device.

FIG. 10 shows a view of the section along line X-X of FIG. 9, so that the side wall (6*a*), front (6*b*) and lower component (6*c*) of the décor component (6) are recognized.

The front panel (3) not shown here is, by the way, fastened directly or indirectly to the décor-front-wall (6*b*). By turning the screwdriver (16), that was brought before from below in an engagement with the teeth (19) on a side edge of the operating element (14). Now the entire slider (15), together with the lifting and lowering element (11) lying opposite the operating element (14), is shifted in the longitudinal axis of the drawer rail (10). Depending upon the direction of rotation the slider (15), and with it the lifting and lowering element (11), then shifts towards or away from the front panel (3) so that the distance between the drawer rail (10) and décor (6) and/or the décor's (6) side-wall-lower-component (6*c*) decreases or increases, so that primarily the inclination angle (8) changes between the levels of the front panel (3) and the cabinet's (1 ) front side (1*a*). FIG. 10 shows the rest of the slider's (15) passage through the décor's (6) recess (30) and/or its lower component (6*c*) on the drawer rail (10), which recess (30) is located before the lifting and lowering element (11).

Figure 11:
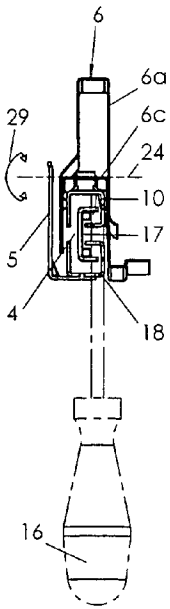
FIG. 11: the side view in direction of arrows XI of FIG. 10.

FIG. 11 shows the side view from the right in arrow direction XI of FIG. 10, where the rail system (4) is better recognized, which consists of the before mentioned drawer rail (10) on which the décor (6) rests or fits, on which décor (6) the drawer itself is fastened with the front (3), bottom and back side. The drawer rail (10) is connected as usual by a roller means with a center rail (17) that is connected for its part by additional roller means with the cabinet rail (18), on which there are two cabinet angles with which the drawer (2) is connected with the cabinet (1). A full-extension rail system is shown, however, the invention can also be used with the partial pull-outs without center rails. Naturally, two rail systems (4) are required for each drawer (2)—one for the left and one for the right.

In FIG. 11 it is good to recognize that the slider (15) rests partly on the upper side of the, drawer rail (10) and partly on the décor-lower-component (6*c*). FIG. 10 shows the slider (15) consists of an operating element (14) from the panel's (3) area, which is rigidly connected by a connection element (28) with the lifting and lowering element (11) that lies near to the cabinet rear-wall. The operating element (14) stretches in the area between the front panel (3) and the beginning of the drawer rail (10), goes over in the connection element (28) that defines a virtual swiveling axis (24) on the front edge of the drawer rail (10) and lies on the décor-lower-component (6*c*) in the rear area of the drawer rail (10). There, the slider (15) then penetrates the décor (6) with its connection element (28), so that a piece can lie on the upper side of the drawer rail (10). Farther back in the direction of the end of the drawer rail (10), the lifting and lowering element (11) is then located, so that the décor-lower-component (6*c*) again penetrates upward over the small slide opening (12), on which the slider (15) lies, in order that subsequently the lower component (6*c*) again penetrates downward over the larger opening (13) and rests upon the drawer rail (10) again.

At the edge of the drawer rail (10) is the virtual swiveling axis (24), around which the décor (6) with the front (3) swings in the swiveling directions (29), if the tool (16) is turned and the slider (15) moves left or right in FIGS. 9 and 10. Then the distance changes between the drawer rail (10) and the décor (6) in all places, except on the swiveling axis (24), but, in particular, on the lifting and lowering element (11), the release for the lifting or lowering cycle/process. The distance of the n extended longitudinal axis of the drawer rail (10) to the décor (6) has unwanted changes in small amounts to the front panel (3); whereby, the front panel (3) is easily lifted or lowered. The drawer rail (10) together with the remaining rails (17, 18) stay unaffected by this and stays in its initial position (for example, in a horizontal position).

Figure 12:
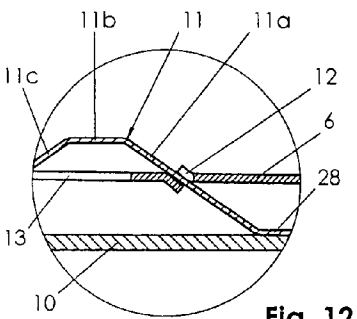
FIG. 12: an enlarged detail of the lifting and lowering element of the slider.

FIG. 12 shows enlarged details of the lifting and lowering element's (11) penetration through the décor (6). The lifting and lowering element (11) is guided into the slide (12) closely fitting, so that the slanted ramps of the slide (12) of the décor (6) can then glide up and down by means of the slide ramps (11*a*). On the slider's (15) slide ramps (11*a*), the plateau (11*b*) closes upward, which only serves the purpose of ensuring a connection for the downward sloping support ramp (11*c*), which again is supported on the drawer rail (10).

Figure 13:
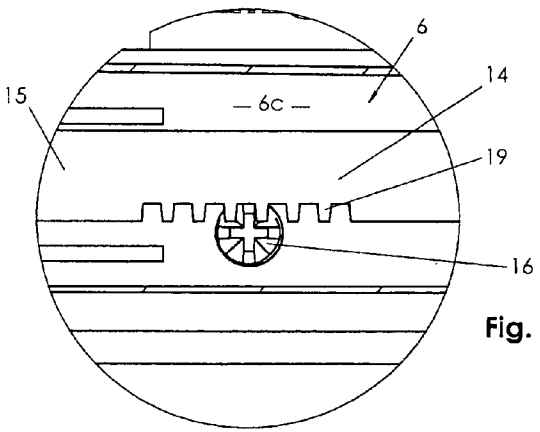
FIG. 13: an enlarged detail of the operating element for the lifting and lowering element when the screwdriver is engaged in the teeth of the slider's operating element.

FIG. 13 shows an enlarged detail of the operating element's support of the lower component (6*c*) of the décor (6). Here, the teeth (19) are recognizable in the side area of the operating element (14), into which the tool engages with its point (here, cross recession/Phillips) and, therefore, the torque of the tool is converted into a linear movement of the slider (15).

Figure 14:
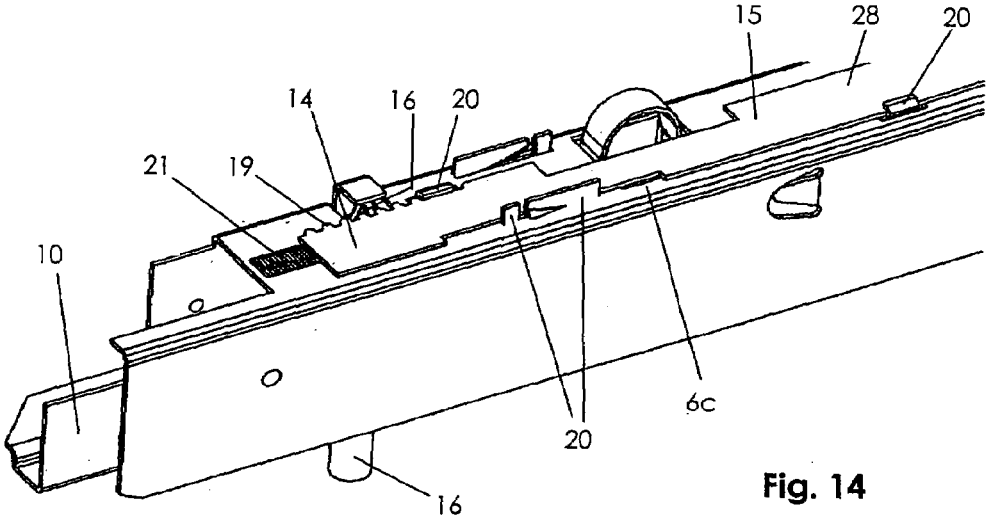
FIG. 14: a perspective view of the shifting mechanism in the area of the operating element for the lifting and lowering element of the slider.

FIG. 14 show a perspective view of the shifting mechanism in the area of the slider's (15) operating element (14). The flat slider (15) is held adjustable/movable on the lower component (6*c*) of the décor-side wall (6*a*) in guide tabs (20). The guide tabs (20) make if possible to slide the slider (15) in the direction of the drawer rail's (10) longitudinal axis and also prevent a crosswise horizontal or optionally vertically shifting. The cross-hole (Phillips) screwdriver (16) engages from below in the lateral teeth (19) of the slider (15). The lengthwise movement can be held with a corrugation (21) between the slider (15) and the lower component (6*c*).

Figure 15:
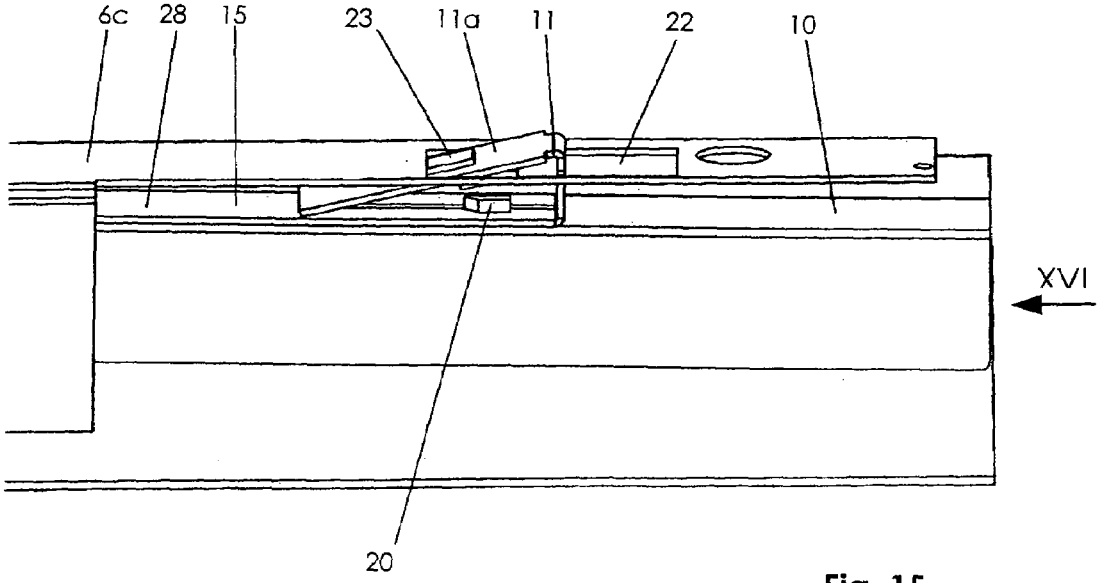
FIG. 15: a perspective view of the shifting/sliding mechanism in the area of the slider's lifting and lowering element.

FIG. 15 shows how the slider (15) made of a metal or plastic band is bent to a wedge-shape slider piece (11), which projects upward through a notch (22) in the décor-lower-component (6*c*) and which lies adjustable/movable with a side on the drawer rail (10) and is supported with a wedge surface (11*a*) that is bent to the drawer's front side (direction panel 3) to an angled guide nose (23) of the side-wall-lower component (6*c*). The slider movement towards the back in the direction of the cabinet's (1) back wall causes a sinking or lowering or the side wall (6*c*) and with it the drawer (2) and similarly in reverse. Here, also, in the wedge's (11) area, a lateral supporting guide tab (20) is on the drawer rail (10), which penetrates a slot of the wedge (11).

Figure 16:
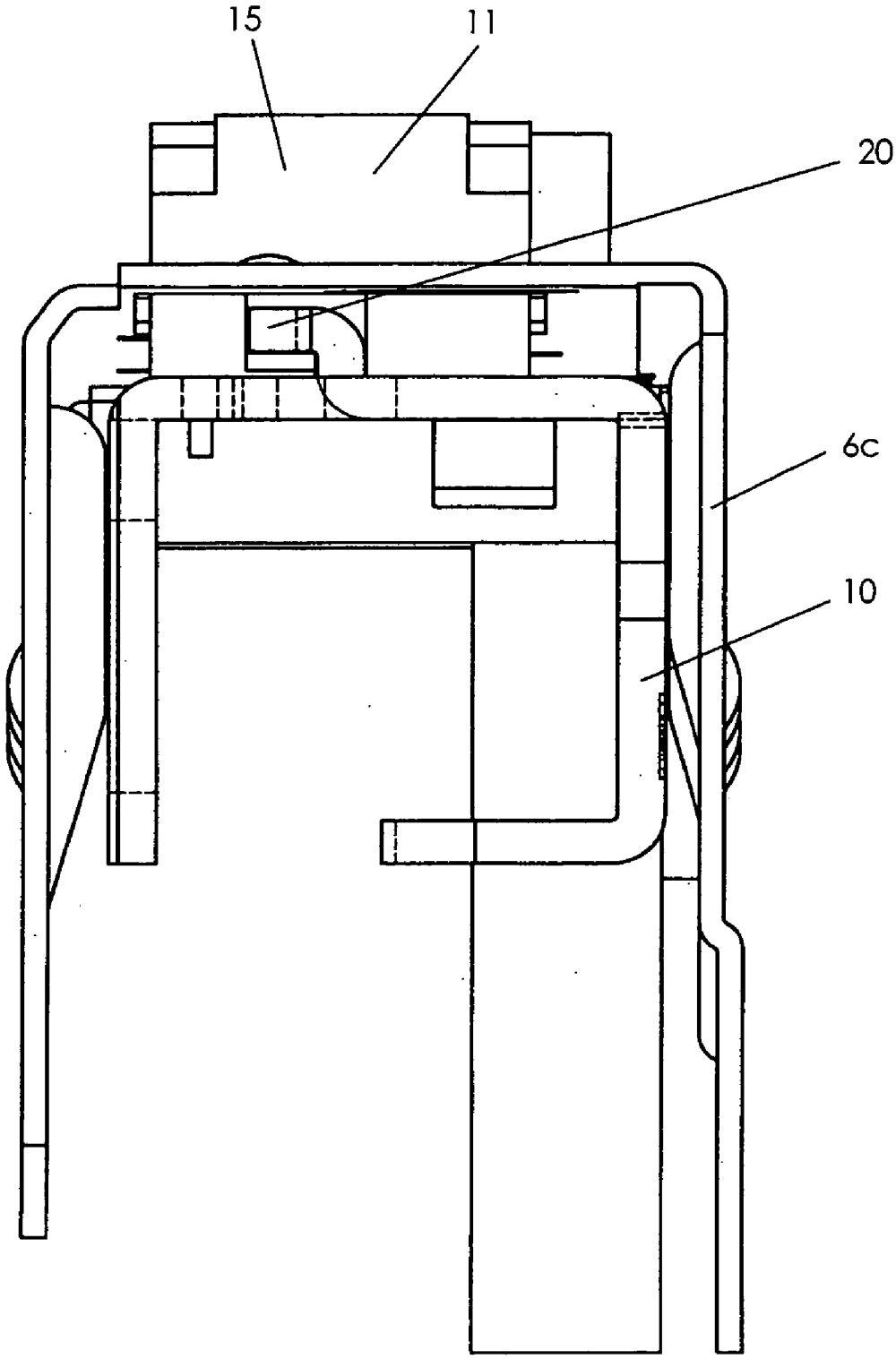
FIG. 16: the side view in arrow direction XVI of FIG. 15.

FIG. 16 is an enlarged side view of FIG. 15 in the viewing direction XVI, where again the arrangement among the slider (15), the upper décor (6) and the lower drawer rail (10) is illustrated.

Figure 17:
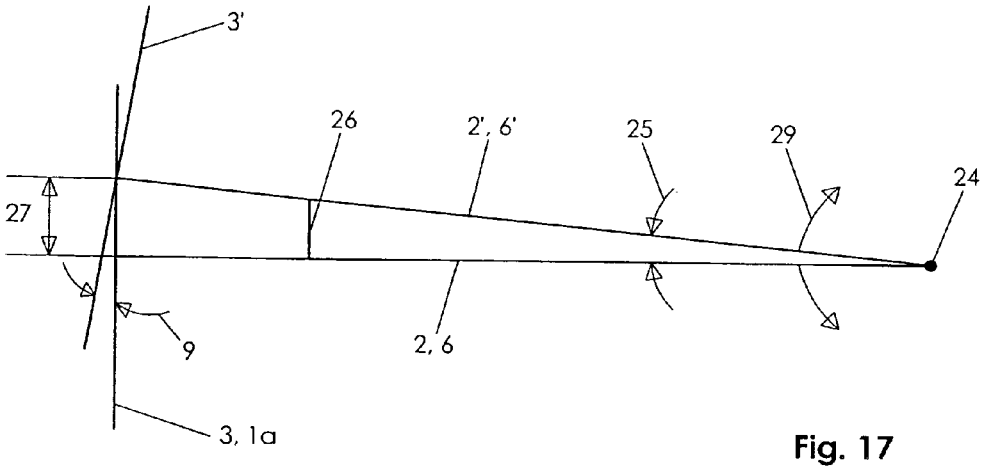
FIG. 17: a principle sketch of the swiveling distance and angle of the drawer and the drawer front with the state of technology.
Figure 18:
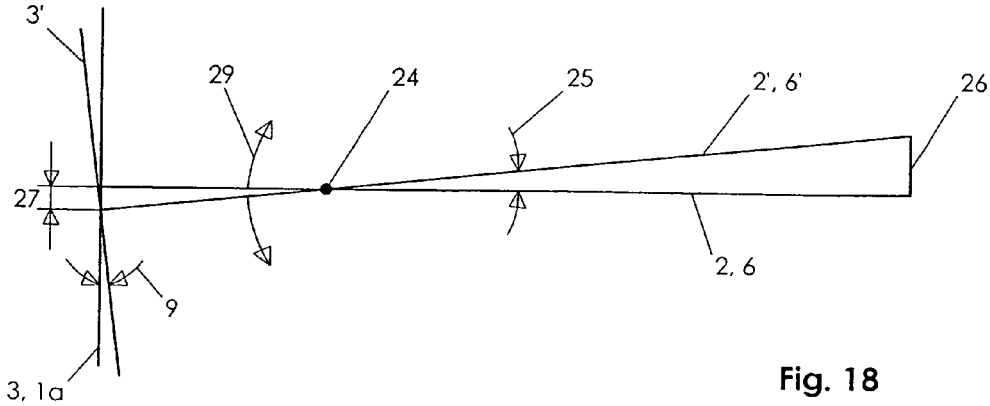
FIG. 18: a principle sketch of the swiveling distance and angle of the drawer and drawer front according to the presented invention.

FIGS. 17 and 18 show principle sketches, such as the swiveling of the drawer (2) and the décor (6) and/or its lower component (6*c*) caused by the raising/sinking of the lifting and lowering element (11) and which effect this has on the lifting and/or lowering of the front panel (3).

FIG. 17 shows the state of technology, according to the closest related AT 409 067 B and DE 44014 462 A1 and FIG. 18 shows the presented invention. A lifting and/or lowering by the lifting and lowering element (11) around the amount (26) (for example, 2 mm) causes a swiveling of the drawer (2) and the décor (6) and/or its lower component (6*c*) around the swiveling axis (24) around in the swiveling direction (29) approximately the angle amount (25) (for example, 5 degrees) in the positions (2', 6') and a swiveling of the panel (3) around the inclination angle (9) between the panel (3) and front side (1*a*) of the cabinet (1) in the position (3'). The angle amount (25) corresponds, thereby, to the inclination angle (9) between the panel (3') and the front side (la) of the cabinet (1). The lifting/lowering amounts (26) and angle amounts (27) are accepted as identical with the state of technology and the presented invention.

Then, resulting from the arrangement of the swiveling axis (24) to the lifting and lowering element (11) and to the panel (3), which with the current state of technology the amount (27) of the lifting and/or lowering of the panel (3) is larger than the amount of the lifting and/or lowering of the lifting and lowering element (11) with an increased speed ratio, is great than 1 depending on the lever ratios in the figures, 1.25 and or 1.5. Hereby, the lifting and lowering element (11) always lies a piece closer to the swiveling axis (24) than the panel (3) so that the deflection of the lifting and lowering elements (11) always entails a positive strengthening (speed increase) of the deflection of the panel (3) as a result.

With the presented invention, however, the arrangement for the state of technology is completely different, because the lifting and lowering element (11) are farther away to the swiveling axis (24) than the panel (3) so that the deflection of the lifting and lowering element (11) always entails a negative reinforcement (reduction) of the deflection of the panel (3).

This is, however, only possible if the swiveling axis (24) is located between the panel (3) and the lifting and lowering element (11). The closer the swiveling axis (24) is to the panel (3) and the father away the swiveling axis (24) is from the lifting and lowering element (11), the less the unwanted deflection of the panel (3) occurs in the height with the same change of the inclination angle (9) between the level of the panel (3) and the level of the front side (1*a*) of the cabinet (1).

So it is ideal for the swiveling axis (24) to be in the area of the panel (3) and/or a lifting and lowering element (11) in the area of the end of the déor (6). In the example shown here the swiveling axis (24) sits on the front edge of the drawer rail (10) and the lifting and lowering element (11) in the rear area of the décor (6); however, not maximally in the back so that a reduction degree of approximately 0.3 results. The 3 mm height deflection (24) of the lifting and lowering element (11), thus, results in approximately 1 mm height deflection (27) of the panel (3'); whereby, with the state of technology about 4 mm height deflection (27) at the panel (3') would adjust itself—thus, 4 times so much.

Therefore, with the present invention, the unwanted height deflection (27) plays no important role and can be ignored when the inclination adjustment of the front panel (3) is made. Thereby a simple, easy and quick inclination adjustment of the angles (9) of the panel (3) is possible with only a panel adjustment device (7), which leads to reduced production, assembly and installation costs.

What is claimed is:

1. Panel adjustment device for a drawer having a front panel attached to the drawer, the drawer being mountable in a drawer opening of a cabinet by means of a rail system with at least one drawer rail supporting the drawer and at least one cabinet rail mountable in the drawer opening for supporting the drawer rail in the drawer opening, which panel adjustment device is operable for changing an enclosed inclination angle defined between a front side of the drawer opening of the cabinet and the front panel of the drawer, the panel adjustment device comprising:

a lifting and lowering device located between the drawer and the drawer rail, the lifting and lowering device having a lifting and lowering element and a swiveling axis, the swiveling axis being disposed between the front panel of the drawer and the lifting and lowering element, and the swiveling axis being spaced from the front panel of the drawer by a distance that is no greater than a distance between the swiveling axis and the lifting and lowering element;

the lifting and lowering element being operable to urge the drawer with the front panel attached to the drawer to swivel relative to the drawer rail about the swiveling axis, resulting in a corresponding change in the enclosed inclination angle defined between the front panel of the drawer and the front side of the drawer opening of the cabinet;

wherein the swiveling axis is closer to the front panel of the drawer than to the lifting and lowering element of the lifting and lowering device;

wherein the swiveling axis lies on the drawer rail, and the lifting and lowering element of the lifting and lowering device is disposed in a rear area of the drawer on a side wall lower component of the drawer;

wherein the lifting and lowering device further comprises a slider, an operating element for the lifting and lowering element, and a connection element connecting the lifting and lowering element in the rear area of the drawer with the operating element; and wherein the operating element for the lifting and lowering element is disposed on the drawer or a décor component of the drawer, and the lifting and lowering element is disposed on the drawer rail, and wherein the slider extends through an opening the drawer or the décor component and into the rear area of the drawer.

2. Panel adjustment device, according to claim 1, wherein the slider bears on one of the drawer, the décor component, and the drawer rail.

3. Panel adjustment device, according to claim 1, wherein the slider is formed as one of a flat band and a wire material and is made of one of metal and plastic.

4. Panel adjustment device, according to claim 1, wherein the slider, the lifting and lowering element, the connection element, and the operating element are formed as one piece.

5. Panel adjustment device, according to claim 1, wherein the operating element has teeth which are engageable by a tool to effect an adjustment of the inclination angle defined between the front panel attached to the drawer and the front side of the drawer opening of the cabinet.

6. Panel adjustment device, according to claim 5, wherein the teeth are provided in a side surface of the operating element.

7. Panel adjustment device, according to claim 1, wherein at least a part of the slider is guided by at least one guide tab on one of the drawer rail, the drawer, and the décor component, and wherein the at least one guide tab forms at least one of a horizontal and a vertical slide, which allows movement of the slider along a longitudinal axis of the drawer rail, but does not allow movement of the slider transverse to the longitudinal axis of the drawer rail.

8. Panel adjustment device, according to claim 1, further comprising a catch mechanism maintaining an adjusted position of said one of the drawer and décor component relative to the drawer rail.

9. Panel adjustment device, according to claim 8, wherein the catch mechanism further comprises self-restraining corrugations provided at least one of cross-wise and diagonally relative to the drawer rail for preventing a shifting of the drawer.

10. Panel adjustment device, according to claim 9, wherein the corrugations are located in an area of the operating element of the lifting and lowering element.

11. Panel adjustment device, according to 1, further comprising stop restrictions provided on at least one of the drawer, the décor component, and the drawer rail, so that the slider cannot be pulled out of a predetermined operating position when the slider is moving in a longitudinal direction of the drawer rail.

12. Panel adjustment device for a drawer having a front panel attached to the drawer, the drawer being mountable in a drawer opening of a cabinet and supported on both sides of the drawer for movement of the drawer within the drawer opening of the cabinet by means of a rail system with at least one drawer rail supporting the drawer and at least one cabinet rail mountable in the drawer opening for supporting the drawer rail in the drawer opening, which panel adjustment device is operable for changing an enclosed inclination angle defined between a front side of the drawer opening of the cabinet and the front panel of the drawer, the panel adjustment device comprising:

a lifting and lowering device located between the drawer and the drawer rail to swivel the drawer relative to the drawer rail about a swiveling axis, the lifting and lowering device further comprising a slider and a lifting and lowering element, the lifting and lowering element being operable to urge the drawer with the front panel attached to the drawer to swivel relative to the drawer rail around the swiveling axis;

wherein the slider is formed out of a flat material, which extends to a back area of the drawer rail and is held movable within the back area of the drawer rail on a horizontal shank of a side wall lower component of the drawer, and wherein the slider has a rear area that is supported on the drawer rail with an end of the slider formed as a wedge-shape sliding piece; and wherein the end of the slider is bent to form the wedge-shape sliding piece, and the wedge-shaped sliding piece bears on the drawer rail and projects through a recess in the horizontal shank of the side wall lower component of the drawer.

* * * * *